US006418843B1

(12) United States Patent
Givler

(10) Patent No.: US 6,418,843 B1
(45) Date of Patent: Jul. 16, 2002

(54) ELEMENT FOR POSITIONING AND SUPPORTING A GOLF BALL AS AN IMAGE IS IMPRINTED THEREON

(75) Inventor: Gregory C. Givler, Naperville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/840,396

(22) Filed: Apr. 23, 2001

(51) Int. Cl.[7] ..... B41F 17/00
(52) U.S. Cl. ..... 101/35; 101/114; 101/DIG. 40
(58) Field of Search ..... 101/35, 4, DIG. 40, 101/38.1, 5–7, 125–128.1, 109, 112, 114; 400/128, 127; 473/406

(56) References Cited

U.S. PATENT DOCUMENTS

| | | | | | |
|---|---|---|---|---|---|
| 1,814,312 | A | * | 7/1931 | Heene | 101/35 |
| 1,921,571 | A | * | 8/1933 | Jones | 101/DIG. 40 |
| 2,005,787 | A | * | 6/1935 | Humphrey | 101/114 |
| 5,827,134 | A | | 10/1998 | Sullivan et al. | 473/372 |
| 5,925,186 | A | | 7/1999 | Klimek | 118/500 |
| 6,179,732 | B1 | | 1/2001 | Inoue et al. | 473/309 |

FOREIGN PATENT DOCUMENTS

| | | |
|---|---|---|
| JP | 06154360 | 3/1994 |
| JP | 10230026 | 2/1998 |
| WO | WO 00/67853 | 11/2000 |

* cited by examiner

*Primary Examiner*—Andrew H. Hirshfeld
*Assistant Examiner*—Minh H. Chau
(74) *Attorney, Agent, or Firm*—Lisa M. Soltis; Mark W. Croll; Donald J. Breh

(57) ABSTRACT

A fixture element which enhances loading/unloading of a ball relative thereto while promoting supporting engagement with and positioning of the ball to allow an image to be imprinted on an outer spherical surface thereof by a printing process requiring a predetermined area defined by the outer spherical surface of said ball to remain unobstructed during the printing process is disclosed. Such element includes a head portion and a shaft portion extending from the head portion. The head portion of the element defines a generally curved inner surface extending thereacross and generally corresponding to a segment on the outer spherical surface of said ball. To increase the interface with the ball, the head portion of the element defines a plurality of circumferentially spaced wings for positioning and supporting the ball engaged thereby for rotation about the axis of the element's shaft portion. When the element is rotated, the wings on the element trace a surface of revolution which extends into and across the predetermined area required for printing. The head portion of the fixture element is configured between the wings to engage, position and support the ball while remaining functionally removed from the predetermined area required for imprinting the image on the outer surface of the ball.

16 Claims, 2 Drawing Sheets

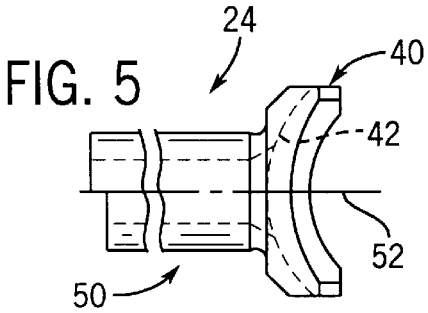
FIG. 5
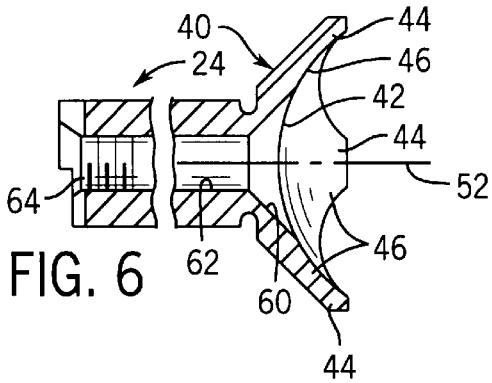
FIG. 6
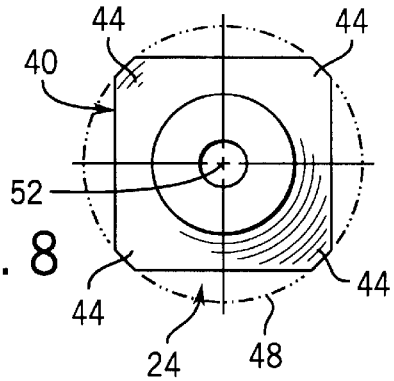
FIG. 8
FIG. 7
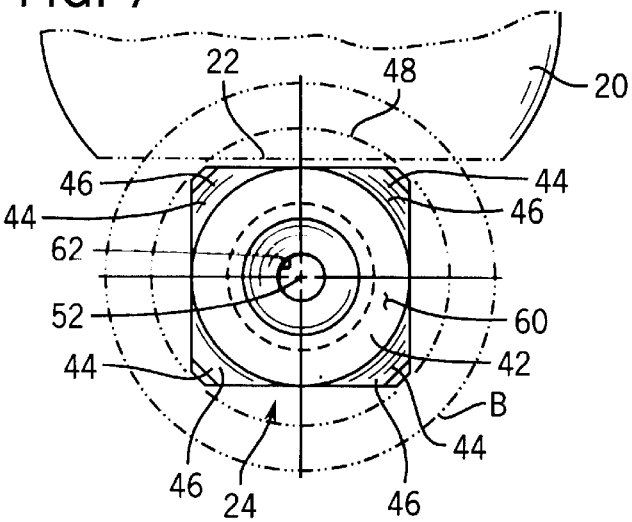
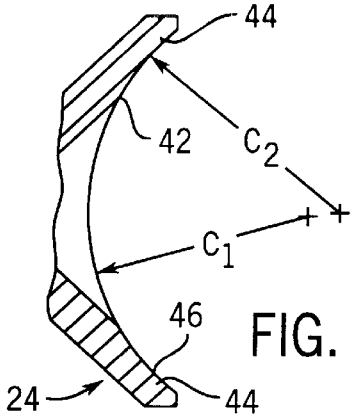
FIG. 9

ELEMENT FOR POSITIONING AND SUPPORTING A GOLF BALL AS AN IMAGE IS IMPRINTED THEREON

FIELD OF THE INVENTION

The present invention generally relates to imprinting one or more images on a ball and, more specifically, to an element for positioning and supporting a golf ball as one or more images are imprinted thereon.

BACKGROUND OF THE INVENTION

Golf balls have a plurality of dimples on the spherical outer surface thereof for improving the direction and flight of the ball. Moreover, an image or mark such as a manufacturer's name, brand name, figures, and numbers are typically imprinted or displayed on the dimpled spherical outer surface of the ball. Conventionally, the image imprinted on the ball is formed from an air drying, heat or UV ink.

The images being imprinted on the ball are becoming more complex. That is, some of the images or figures imprinted on the dimpled spherical outer surface of the ball involve superimposing two or more color images upon each other to provide a cumulative image or design on the ball. Moreover, some golf balls have one or more images imprinted on various surface areas of the ball. As will be appreciated, locating or positioning each image on the ball, and especially when two images are to be superimposed upon each other, is of paramount concern. In those instances where two or more images are superimposed but are not precisely located relative to each other, the color or design from one image can "run over" into the other image, thus, adversely effecting the overall aesthetics of the image. Moreover, even a slight offset between two separate superimposed imprinted images can be noticeable.

Manually printing each image on a golf ball involves a labor intensive and, thus, costly effort. Of course, manufacturers and/or sellers of golf balls typically require a particular image or figure to be timely imprinted on hundreds if not thousands of golf balls. Accordingly, automated machines have been specifically designed for imprinting the outer spherical surface of a golf ball with one or more desired images thereon.

Screen printing on spherical surfaces such as golf balls can be difficult. As a result, a pad printing process is customarily used for marking or imprinting images on a golf ball spherical surface. Pad printing machines typically include a flexible ink transfer pad that receives an ink image from a flat inked gravure plate upon being placed into pressure contact with the gravure plate. The transfer pad is then removed from the gravure plate and pressed into contact with a spherical curved surface on the ball to be printed. The flexible nature of the pad enables the ink image to be transferred from the pad onto the spherical curved surface of the golf ball. Of course, to effectively transfer and imprint the image to the spherical surface of the ball, a predetermined area relative to the golf ball's spherical outer surface must remain unobstructed and unrestricted during the pad printing process to allow the ink pad to compress and flexurally deform about the spherical outer surface of the ball.

To facilitate the pad printing process, a golf ball is automatically loaded into a ball holding fixture at a loading station and the fixture is moved toward a printing station whereat the pad printing process is effected. After an image is imprinted on the ball, the fixture can be moved to another printing station whereat a second image or marking is imprinted on the ball. Alternatively, the golf ball may be rotated through a predetermined arc before the second image or marking is imprinted on the outer spherical surface of the ball.

Typically, such ball holding fixtures operate in combination with a ball loading apparatus designed to present and automatically load a golf ball between axially aligned and spaced fixture elements or spindles which capture the golf ball to be imprinted therebetween. The fixture elements or spindles for holding the ball therebetween are axially aligned along an axis extending generally normal to the direction the flexible ink pad is pressed against the outer spherical surface of the ball. At least one of the spindles or elements is movable relative to the other spindle or element such that a predetermined axial pressure or load is exerted onto the elements for releasably holding the ball to be imprinted therebetween. Moreover, such fixtures are known to include indexing devices for rotating the elements or spindles and thereby the ball entrapped and supported therebetween through the predetermined arc and into a desired position for printing by the flexible pad at the printing station.

Such fixtures for holding the ball for printing typically have no support directly opposite the side of the ball which is to be imprinted. Accordingly, only the design of the ball holding elements or spindles and the pressures exerted on the ball by such elements or spindles serve to establish a mechanical interlock and support the ball during the printing process. Of course, if too little pressure is applied by the elements, the ball is likely to slip between the elements during the printing process. Moreover, too little pressure applied to the ball by the fixture elements furthermore increases the likelihood the ball will rotationally slip or move between the elements when the ball is rotated. Accordingly, overlying or superimposed images to be imprinted on the ball will most likely not be in alignment, thus, producing an inferior printed image. Of course, the dimpled configuration on the outer surface of the ball detracts from—rather than helping to—establish positive engagement between the fixture spindles or elements and the ball.

On the other hand, when too much pressure is exerted against a ball by the elements or spindles, the spherical configuration of the ball and the dimples thereon can be distorted or deformed. Even after the printing process is completed such deformation or distortion of the ball's outer spherical surface and dimples can remain rather than the ball and dimples automatically reverting to their original shape. As a result, the balls lose their uniformity which adversely affects the flight performance of the ball.

Various efforts have been attempted to enhance the interface between the fixture elements or spindles and the golf balls which they are designed to support, position and hold during the printing process. One such effort involves providing one or more machined slots on the surface of the spindles or elements which engage the ball. Theoretically, the machined slots provide sharp edges on the elements or spindles to enhance their engagement with the dimpled outer surface on the ball and, thus, inhibit relative rotation therebetween. Unfortunately, when such slotted elements or spindles are pressed against the ball, the actual surface area contact between the element's sharp edge and the ball is very limited. Accordingly, extremely high loads exist between the sharp edge of the element and the outer surface of the golf ball. Such high loads tend to cause physical damage and cutting of the outer dimpled configuration of the golf ball thereby adversely affecting the outer surface and resulting performance of the ball. As will be appreciated by those skilled in the art, the dimples on the ball may not necessarily align with the sharp edges on the fixture elements and, thus, the ball may slip upon rotation of the elements.

Other efforts at supporting and enhancing the interface between the fixture elements and the golf ball involve increasing the surface area contact between the fixture elements and the ball. Theoretically, such efforts involve supporting the golf ball at points or locations distantly spaced as far as possible from the axis of rotation of the fixture element or spindle. Unfortunately, when such fixture spindles or elements are rotated to reposition the golf ball for pad printing, the increased size of the fixture element or spindle functionally interferes or is an obstruction to that unrestricted area on the golf ball required for printing of an image. Increasing the size of the fixture element furthermore is likely to interfere with or complicate loading/unloading of the ball intoi and from the fixture. Thus, while such fixture element or spindle designs would appear to enhance support and positioning capabilities for the fixture elements relative to the golf ball, such fixture element or spindle designs having such enlarged surface area contact with the golf ball are such that at least some portion of the fixture element or spindle extends into that area which must remain unrestricted and unobstructed for printing purposes and complicates the loading and unloading of the ball into the fixture.

Thus, there is a continuing need and desire for a fixture element or spindle which provides improved support engagement with and positioning of a golf ball without hindering loading/unloading of the golf ball from the fixture and while remaining functionally removed from the predetermined area required for imprinting the image on the spherical, dimpled outer surface of the ball as through a printing process.

SUMMARY OF THE INVENTION

In view of the above, and in accordance with the present invention there is provided a fixture or cup element which is designed to enhance supporting engagement with and positioning of the golf ball to allow an image to be imprinted on an outer spherical surface thereof by a printing process requiring a predetermined area defined by the outer spherical surface of said golf ball to remain functionally unobstructed during the printing process. Such element includes a head or cup portion having a shaft portion extending therefrom. The head or cup portion of the element defines a generally curved inner surface extending thereacross and generally corresponding to a segment on the outer spherical surface of the golf ball. To increase the interface with the golf ball, the head portion of the element defines a plurality of circumferentially spaced wings for positioning and supporting the golf ball engaged thereby for rotation about the axis of the element's shaft portion. When the element is rotated, the wings on the element trace a generally spherical surface of revolution which functionally extends into and across the predetermined area required for printing. The head portion of the element is configured, however, between the wings to engage, position and support the golf ball while remaining functionally removed from the predetermined area required for imprinting the image on the ball.

In a preferred embodiment, the fixture element is further designed to enhance automated loading/unloading of a golf ball relative thereto. That is, the wings and the head or cup portion of the fixture element are configured to promote automated introduction and loading movements of the ball relative to the head portion of the element.

According to one form, the fixture element has at least two wings which are circumferentially and appropriately spaced about the element's cup or head portion for supporting and positioning a golf ball which is to printed with an image. The element's wings or extensions are each configured or designed to maximize their surface area contact with the golf ball's outer surface while remaining functionally removed from the predetermined area required for imprinting the image on the ball's outer surface after the golf ball is positioned for printing thereon.

The inner generally curved surface of the head or cup portion of the element preferably extends outward to the periphery of the wings. Moreover, the inner generally curved surface of the wings is textured to enhance frictional surface contact between the wings and the outer surface of the golf ball thereby promoting rotation of the golf ball conjointly with the element whereby enhancing positioning of the golf ball during the printing process. To promote optimum use of the element in combination with more than one golf ball diameter, the generally curved inner surface of each wing is defined by at least two different sections.

In a preferred embodiment, a relief is defined at the center of the element's cup or head portion, and the inner golf ball engaging surface of the element's head portion extends outwardly from that relief. In another form, the shaft portion of the element defines a bore which opens, at least, at one end thereof Internal threading can be provided along a lengthwise section of the bore.

In another form, an end of the shaft portion opposite from the fixture element's head or cup portion is configured for operable attachment to a ball indexing mechanism. To promote precise positioning of the ball for printing, that end of the shaft portion operably connected to the indexing mechanism is configured to minimize non-mating rotation between the indexing mechanism, the fixture element operably connected thereto, and the ball.

A primary object of the present invention is to provide an element which positions and provides maximum support for a golf ball during a pad printing process wherein an image is imprinted on the outer surface of the golf ball.

Another object of this invention is to provide a golf ball positioning and supporting element which maximizes ball support while allowing one or more superimposed images to be printed on an outer surface of the golf ball through a pad printing process without any accompanying loss in the unobstructed area required for printing those images.

Still another object of this invention is to provide a golf ball positioning and supporting element which is specifically designed to maximize support for the golf ball to be imprinted with an image and which element design facilitates automated introduction of the golf ball relative to a head portion of the fixture element during a golf ball loading process.

Still another object of this invention is to provide a golf ball positioning and supporting element having a golf ball engaging surface which is specifically designed to maximize support for the golf ball and which is textured to promote conjoined rotation and maximize frictional support forces between the element and the golf ball to be imprinted with an image on the outer surface thereof.

Yet another object of this invention is to provide a positioning and supporting element for a golf ball to be imprinted with an image during a pad printing process, and wherein the element is configured with golf ball engaging features which, upon rotation of the element, define a surface of revolution which extends into that area required for imprinting the golf ball with the image during the pad printing process but which golf ball engaging features are functionally removed from the area required for imprinting the golf ball with the image during the pad printing process.

These and other objects, aims and advantages of the present invention will become more readily apparent from the following disclosure, appended claims, and the attached drawings of a preferred embodiment of the invention.

DESCRIPTION OF THE DRAWINGS

FIG. 1 is a schematic illustration of a system for loading an printing images or marks on golf balls and the like;

FIG. 5 is a side elevational view of an element according to the present invention;

FIG. 6 is an enlarged longitudinal sectional view of the element shown in FIG. 5;

FIG. 7 is an end view of the element illustrated in FIG. 5 with an outline of a golf ball to be imprinted with an image shown in dash lines and an ink pad of a pad printing machine being shown in position to effect transfer of an image or mart from the pad to the golf ball;

FIG. 8 is an end view of the element illustrated in FIG. 5 with a generally spherical surface of revolution of the wings or extensions on said element being illustrated in a dash line; and FIG. 9 is an enlarged sectional view similar to that illustrated in FIG. 6 but wherein the curved inner surface of the element is defined by at least two different radii.

DETAILED DESCRIPTION OF THE INVENTION

Figure 1:
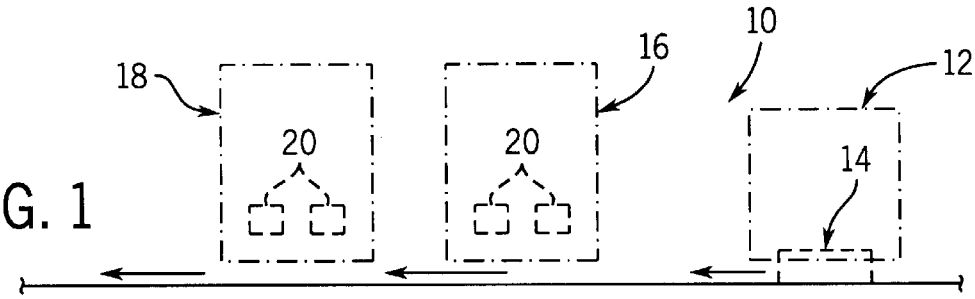

While the present invention is susceptible of embodiment in multiple forms, there is shown in the drawings and will hereinafter be described preferred embodiments of the invention, with the understanding the present disclosure is to be considered as setting forth exemplifications of the invention which are not intended to limit the invention to the specific embodiments illustrated and described.

Referring now to the drawings, wherein like reference numerals indicate like parts throughout the several views, there is schematically illustrated in FIG. 1 an apparatus or system, generally indicated by reference numeral 10, for imprinting a mark or image on an object having a spherical outer surface. For purposes of this disclosure, the term "mark" or "image" means any of a myriad of designs including a manufacturer's name, a brand name, figures, numbers and etc. which are to be imprinted on the outer spherical surface of an object Moreover, the mark of image to be imprinted on the outer spherical surface of the object can comprise a composite design wherein two or more images or designs are imprinted on the object in complementary relation relative to each other such that one imprinted image or design may be in one color and the other imprinted design or image is a second color but together the two imprinted images collectively provide what appears to be an image of a single design. Moreover, in the exemplary embodiment, the object on which the image is to be imprinted is a golf ball having a spherical outer surface which is dimpled.

In the exemplary embodiment schematically illustrated in FIG. 1, the apparatus or system 10 includes a loading station 12 whereat one or more golf balls to be imprinted with an mark or image are loaded into a fixture 14 for movement along a predetermined path of travel. In a most preferred form, the apparatus 10 will effect automatic loading of one or more of the balls to be imprinted into the fixture 14. After loading, the fixture and the balls carried thereby are moved along the predetermined path of travel to a first printing station 16 . In the embodiment illustrated, the apparatus or system 10 involves a second printing station 18 which is arranged downstream of the first printing station 16.

To enhance imprinting the images on the balls, the printing stations 16 and 18 are defined by conventional ink pad printing machines. Suffice it to say, the pad printing machine at each station 16, 18 includes one or more ink transfer pads 20 depending upon the number of objects carried by the fixture 14 for printing. As is known in the art, the ink transfer pad 20 is arranged on each printing machine for vertical and horizontal movements under the influence of a well known coordinated driving mechanism (not shown) between an inking position, wherein the pad 20 is pressed against a flat gravure plate (not shown) to receive an ink pattern therefrom, and a printing position, wherein the pad 20 is moved into pressure contact with the recipient object, i e., golf ball, with a predetermined force, to transfer the ink pattern thereto. After imprinting the golf ball with a mark or image, the pad 20 is returned to operable association with the gravure plate for reinking and the fixture 14 is automatically moved to the next printing station 18.

The transfer or printing pad 20 for each printing machine is formed of a flexible material, preferably silicone or other suitable material. As will be appreciated, during the pad printing process, the printing pad 20 compresses and flexurally deforms about the spherical outer surface of the ball to be imprinted to effect a complete transfer of the image or mark onto the ball's outer spherical surface. Moreover, the size of the mark or image to be imprinted on the object or ball effects the size of the pad 20. Of course, the path of the pad 20 and the predetermined area on the golf ball B, generally indicated in FIG. 2 by reference numeral 22, where the image or mark is to be imprinted must remain functionally unobstructed and unrestricted during the pad printing process. Additionally, the size of the predetermined area 22 which must remain unobstructed or unrestricted can change as a function of the size of the image as well as the size and degree of deformation required of the ink printing pad 20 during the printing process.

Figure 3:
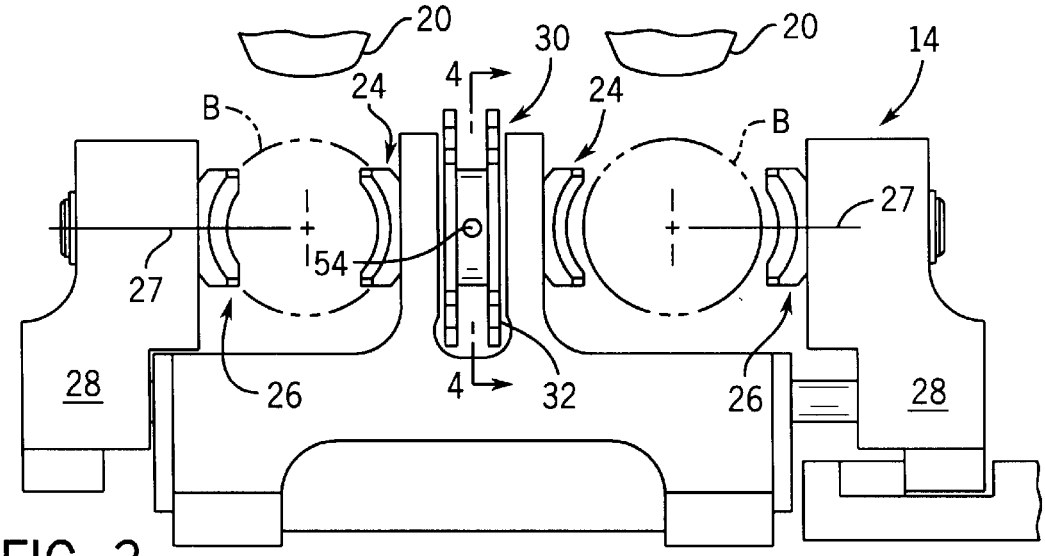
FIG. 3 is a side elevational view of a fixture for releasably holding, positioning and supporting a golf ball for printing as through a pad printing process.

As shown in FIG. 3, the ball B to be imprinted with the image or mark is held in the fixture 14 between a pair of spaced spindles or cup elements 24, 26 which are axially aligned relative to each other along axis 27 which, as described below, also defines an axis of rotation for the ball B. Notably, when the ball B is mounted in the fixture 14, no support is provided by the fixture 14 directly opposite from the side of the ball B to be imprinted with an image. In the illustrated embodiment, fixture 14 is configured to releasably hold and support two spherical objects for imprinting. It should be appreciated, however, the fixture 14 can otherwise be configured without detracting or departing from the spirt and scope of the present invention.

Suffice it to say, fixture 14 includes two movable spindle mounts 28. Each movable spindle mount 28 carries spindle 26 therewith. Each spindle mount 28 is movable to increase the axial spacing between the spindles 24, 26 thereby facilitating automated loading of the ball to be imprinted therebetween. As will be appreciated, after the ball B is loaded between spindles 24 and 26, each spindle mount 28 is driven such that the ball B is pressed between the spindles 24 and 26 on the fixture 14.

In the illustrated embodiment, fixture 14 furthermore includes an apparatus 30 for rotationally indexing the ball B held within the fixture 14 about axis 27 such that more than one image or mark can be imprinted on the outer surface of the ball B at different locations on the ball B. As will be appreciated by those skilled in the art, apparatus 30 can take a myriad of different designs and configurations.

Figure 4:
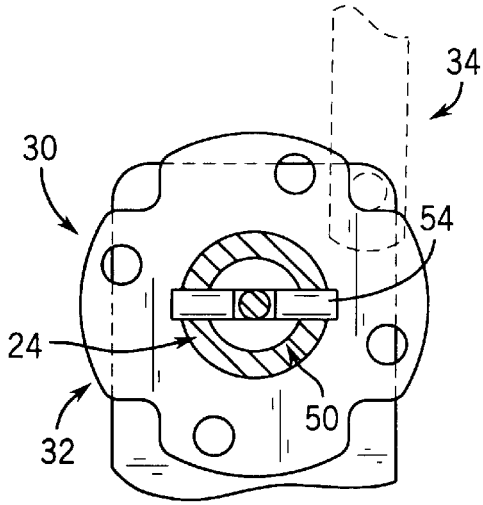
FIG. 4 is a sectional view taken along line 4—4 of FIG. 3.

In the exemplary embodiment illustrated in FIGS. 3 and 4, apparatus 30 includes an indexing device 32 which is arranged in operable combination with a known driving mechanism 34 (FIG. 4). In a manner further described below, the indexing device 32 is operably connected to each spindle 24 on fixture 14. As such, and when apparatus 30 is operated to index device 32, the spindle 24 operably connected thereto, and the ball B, are each turned or rotated through a predetermined arc about axis 27 to present a desired portion of the outer surface of the ball B to the printing pad 20 of a printing machine to imprint an image on the ball B.

In accordance with the invention, element 24 is operably connected to the indexing apparatus 30 and is configured to promote automated loading of a ball B to, and thereafter support and positioning of the ball B within the fixture 14 to enhance printing of a mark or image on the outer surface of the ball B. As shown in FIG. 5, fixture element or spindle 24 includes a head portion 40 and a shaft portion 50 defining an axis 52 about which element 24 rotates or turns. As shown in FIGS. 5 and 6, the head or cup portion 40 defines a generally curved or concave inner surface 42 extending thereacross which generally corresponds to that segment on the outer spherical surface of the ball B which is to be engaged and supported by element 24.

As illustrated in FIGS. 6 and 7, the head or cup portion 40 of element 24 is configured with a plurality of circumferentially and appropriately spaced wings or extensions 44 which radiate outwardly from the axis 52 of revolution of the element 24 for positioning and supporting the ball B engaged thereby. Each wing 44 on the head portion 40 of element 24 defines an inner generally curved surface 46 extending thereacross and which comprises an extension of the inner generally curved surface 42 of the head portion 40. At least the inner generally curved surface 46 on the wings 44 is textured to enhance frictional surface contact between the wings or extensions 44 and the outer surface of the ball B (FIG. 6) thereby promoting rotation of the ball B conjointly with element 24 and, thus, reducing slippage therebetween. Moreover, the texturing provided on at least the inner generally curved surface 46 of the wings 44 maximizes the frictional support surfaces provided by the element 24. Such texturing is preferably derived from a glass-bead blasting process to remove visible tool marks and provide a textured or matt finish to enhance the surface contact interface between the inner curved surface 46 on the wings 44 and the dimpled outer spherical surface on the golf ball B held and positioned thereby.

Figure 2:
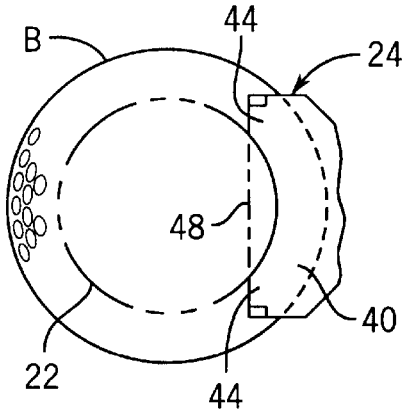
FIG. 2 is a schematic illustration of a golf ball and fixture element according to the present invention arranged in operable association relative to each other.

As schematically illustrated in FIGS. 2, 7 and 8, the wings 44 on the head portion 40 of element 24 define a generally spherical surface of revolution, indicated by reference numeral 48, when element 24 is rotated by the indexing apparatus 30 (FIG. 3). As schematically illustrated in FIGS. 2 and 7, the generally spherical surface of revolution 48, traced by the wings 44 on the head portion 40 of element 24 upon rotation thereof, operably extends into and across that predetermined area 22 required for imprinting the ball B with an image as through an ink cup printing pressing process. That is, and as schematically illustrated in FIG. 7, the wings 44 extend away from the axis 52 of rotation of element 24 to such an extent that, when element 24 is rotated about axis 52, the generally spherical surface of revolution 48 defined by the wings 44 operationally interferes with the predetermined area 22 which must remain unobstructed and unhindered for printing an image on the ball with the ink pad 20.

A salient feature of the present invention relates to configuring the head portion 40 of element 24 between the spaced wings 44 to remain removed from the predetermined area required for imprinting the desired image on the outer spherical and dimpled surface of the ball B. That is, the wings 44 and those areas on the head or cup portion 40 extending between the wings 44 are configured to engage, position and support the ball B while remaining functionally removed from the predetermined area required by the printing pad 20 for imprinting the desired image or mark on the golf ball B.

In the illustrated embodiment, and as schematically represented in FIG. 7, the element's head or cup portion 40 has a shape approximated by a truncated hemisphere with an inscribed polygon. Since the illustrated embodiment is provided with four circumferentially spaced wings or extensions 44, which are preferably equally spaced relative to each other, the head portion 40 of element or spindle 24 is inscribed with a polygon in the shape of a square. As schematically illustrated in FIG. 7, the truncations on the element's head portion 40 configure the head or cup portion 40 such that the area between the wings 44 remains functionally removed from the predetermined area required by the printing pad 20 for imprinting the desired image or mark on the ball B.

As illustrated in FIGS. 5 and 6, the shaft portion 50 of element 24 has a generally outer cylindrical configuration and extends from the head portion 40. Notably, the axis 52 defined by shaft portion 50 extends through or intersects with the inner surface 42 of the head portion 40. The free end of shaft portion 50 is preferably configured such that when element 24 is operably connected to the indexing mechanism 30 (FIG. 3), a zero-backlash connection is established therebetween. As will be appreciated, several alternative designs could be utilized to establish a zero-backlash connection between the shaft portion 50 of element 24 and the indexing wheel 32, without detracting or departing from the spirit and scope of the present invention.

In the exemplary embodiment shown in FIG. 4, the free end of the shaft portion 50 of element 24 is configured to operate in conjunction with a radially extending pin 54 carried by the indexing device 32. Suffice it to say, the element or spindle 24 on the fixture 14 (FIG. 3) is releasably secured to the indexing device 32 such that a drive connection with zero-backlash will be established between the shaft 50 of each element 24 and the indexing wheel 32. That is, when the indexing mechanism 30 is operated to rotate or index the ball B, the shaft portion 50 is designed to establish a connection between the element 24 and the indexing device 32 such that non-matching rotation of the element 24 and the indexing device 32 is minimized.

In the embodiment illustrated in FIGS. 6 and 7, the element's head or cup portion 40 further defines a centrally disposed relief 60 with the inner generally curved surface 42 of the head portion 40 radially extending outwardly therefrom. Moreover, and as shown in FIGS. 5 through 8, element 24 can further define a longitudinally elongated bore or opening 62 extending generally parallel to axis 52. In the illustrated form, bore 62 extends generally coaxial relative to shaft portion 50 of element 24 and opens at opposite ends thereof A lengthwise section of the bore 62 can include internal threading 64. In one form, the internal threading 64 cooperates with a suitable fastener (not shown) for drawing the axially aligned elements 24 on fixture 14 (FIG. 3) toward one another thereby facilitating their releasable connection with device 32 of indexing mechanism 30.

In an alternative embodiment illustrated in FIG. 9, the inner generally curved surface 46 on the wings or extensions 44 of the cup or head portion 40 is configured to facilitate use of element 24 with spherical objects having more than one diameter. Recently, golf balls are being designed and sized with more then one diameter. Accordingly, the inner generally curved surface 42 of the head portion 40 of element 24, and more particularly the generally curved inner surface 46 on the wings 44, is formed with two radiuses or scetions schematically illustrated in FIG. 9 as $C_1$ and $C_2$. Although the difference between the two radii $C_1$ and $C_2$ is somewhat exaggerated in FIG. 9, it should be appreciated the different sizes of the curves or sections $C_1$ and $C_2$ on the inner surface of the head portion 40 of element 24 will readily allow element 24 to support and position spherical objects, i.e., golf balls, of different diameter without having to redesign and change fixture 14 for every change in the diameter of a golf ball to be imprinted with an image or mark.

This invention approaches the problem of how to support a golf ball for pad printing with the understanding the supporting "real estate" on the ball's outer surface must be maximized to effect the best ball support and positioning possible. In this regard, this invention is the first to configure the geometry of the fixture element 24 such that only those predetermined areas on the ball's outer surface which must remain functionally unobstructed or unhindered for pad printing purposes or to facilitate loading of the ball to the fixture 14 are the only areas that are specifically excluded from ball support. All the other areas on the ball's outer surface, however, are usable to maximize ball support and positioning capabilities for the fixture element or spindle 24.

As will be appreciated from an understanding of the invention, the unique geometry of the spindle or element 14 enhances the interface between the inner curved surface 42 of the element 24 and the golf ball by providing more support area for the golf ball engaged thereby. Moreover, the cup or head portion design of the fixture element, while advantageously offering improved support, provides such support in those specific areas best suited for opposing those force vectors applied to the golf ball by the ink pad 20 during the ink pad printing process. Testing has revealed the unique geometry of the fixture element 24 results in more uniform compressive (radial) loading than with heretofore known fixture elements used to releasably hold a spherical object therebetween for imprinting as through a pad printing process. The unique element design presented by this invention advantageously allows a lesser compressive force to be applied to the ball, resulting in less deformation of the ball and the dimples thereon during the printing process. Furthermore, the additional curvature coverage provided by the radial wings or extensions 44 also aids in loading the ball accurately on-center, due to the more radial nature of the support.

The shape of the truncations on the element's head portion 40 are specifically shaped to allow the fixture element 24 to add more support while maintaining that predetermined area of the outer ball surface required for pad printing operationally unrestricted and unencumbered during the printing process. Accordingly, the ink pad 20 is permitted to deform and effectively transfer the image or mark onto the outer ball surface without the fixture element 24 functionally interfering with the printing process. Moreover, the wings or radial extensions 44 on the element 24 are disposed and designed to remain clear of the ball during loading/unloading of the ball into/from the fixture 14. As will be appreciated from an understanding of the invention, the wings or extensions 44 and the truncations on the fixture element 24 can be orientated so as to align with the loading method used, which could be linear or rotational.

As will be appreciated, the extensions or wings 44 on the fixture element 24 and, more specifically, the increased radial coverage of the ball's outer surface by the inner curved surface 46 of the wings 44 and their interface with the outer spherical surface of the ball B relative to the axis 52 significantly enhances the moment arm of the element 24 when the ball is to be rotated about axis 26 by the indexing mechanism 30. Moreover, the textured surface on the inner curved surface 46 of the extensions or wings 44 is significantly better than using micro-serrations since the textured finish contact with the ball's outer spherical surface occurs only on the circuitous raised sections surrounding the dimples. As will be appreciated, the textured finish on the inner generally curved surface 46 of the wings 44, offered with a preferred embodiment, generates a mechanical interference with the ball's outer surface without effecting cutting or imparting serrations to the ball's outer surface. Accordingly, the slippage between the outer surface of the ball and the inner surface 42 of element 24 is minimized as the ball B is rotated about axis 26. Minimizing ball slippage, of course, allows overlying or concentric images to be accurately placed on the ball's outer surface thereby adding clarity and preciseness to the resultant cumulative image without concern over distinct colors variations impinging upon each other.

In the alternative embodiment, the inner generally curved surfaces 42 and 46 of the fixture element 24 are shaped with at least two different radiuses or sections $C_1$ and $C_2$. Accordingly, the same fixture element 24 can be used when imprinting balls having outer surfaces of different diameters. That is, a ball having a first diameter can interface with the inner surfaces 42 and 46 of element or spindle 24 defined by radius $C_1$ whereas another ball, having an outer surface with a slightly different diameter, can interface with the inner surfaces 42 and 46 of element or spindle 24 defined by radius $C_2$. As will be appreciated, the purpose of the different radii $C_1$ and $C_2$ on the inner surface 42 of the element or spindle 24 is to maximize surface contact with the ball being positioned and supported by such element or spindle 24.

From the foregoing it will be readily appreciated and observed that numerous modifications and variations can be effected without departing from the true spirit and scope of the novel concept of the present invention. It will be appreciated that the present disclosure is intended to set forth an exemplification of the present invention which is not intended to limit the invention to the specific embodiment illustrated. The disclosure is intended to cover by the appended claims all such modification and colorful variations as fall within the spirt and scope of the claims.

What is claimed is:

1. An element for positioning a ball to allow an image to be imprinted on an outer spherical surface thereof by a printing process requiring a predetermined area defined by the outer spherical surface of said ball to remain unobstructed during the printing process, said element including a head portion and a shaft portion extending from said head portion, said head portion defining a generally curved inner surface extending thereacross and generally corresponding to a segment on the outer spherical surface of said ball, with said head portion defining a plurality of circumferentially spaced wings for positioning and supporting a ball engaged thereby for rotation about the axis of said shaft portion, and wherein said wings define a surface of revolution when said element is rotated, with said surface of revolution defined by said wings upon rotation of said element extending into and across said predetermined area required for printing, and whereby said head portion of said element is configured between said wings to engage, position and support the ball while remaining functionally removed from said predetermined area required for imprinting said image on the outer surface of said ball.

2. The element according to claim 1 wherein the wings on said head portion of said element are circumferentially positioned to promote automated loading movement of said ball relative to said element.

3. The element according to claim 1 wherein at least two wings are circumferentially spaced about the head portion of said element, with said wings being configured to maximize their surface area contact with the outer periphery of the ball while remaining functionally removed from said predetermined area required for imprinting said image on the outer spherical surface of said ball after said ball is positioned to have said image imprinted thereon.

4. The element according to claim 1 wherein the generally curved inner surface of said head portion extends outward to the periphery of said wings and is textured to enhance frictional surface contact between said wings and the outer spherical surface of said ball thereby promoting rotation of said ball conjointly with said element to enhance positioning of said ball.

5. The element according to claim 4 wherein the generally curved inner surface of each wing is defined by at least two different sections whereby allowing said element to be used in combination with balls of different diameters.

6. The element according to claim 4 wherein a relief is defined at the center of said head portion, and with said inner generally curved surface extending radially outward from said relief.

7. An element for positioning a golf ball to allow an image to be imprinted on an outer and dimpled spherical surface thereof by a pad printing process requiring a predetermined area defined by the outer spherical surface of said golf ball to remain unobstructed during the printing process, said element including a shaft portion defining an elongated axis and a head portion disposed at a first end of said shaft portion, said head portion defining an inner generally curved surface extending thereacross and generally corresponding to a segment on the outer dimpled surface of said golf ball, with said head portion defining a plurality of circumferentially spaced wings radially extending outwardly from said axis for engaging, positioning and supporting a golf ball without affecting damage to the outer dimpled surface thereof, and whereby said wings extend radially outward from said elongated axis to enhance the golf ball engaging surface area and moment arm of said element while defining a surface of revolution which, when said element is rotated, interferes with said predetermined area required for printing, and whereby said head portion of said element is configured between said wings to remain functionally removed from said predetermined area required for imprinting said image on the outer spherical and dimpled surface of said golf ball.

8. The element according to claim 7 wherein at least three wings are circumferentially arranged about the head portion of said element, with each wing being configured to maximize their surface area contact with the outer periphery of the golf ball while remaining functionally removed from said predetermined area required for imprinting said image on the outer spherical surface of said golf ball after said golf ball is positioned to have said image imprinted thereon.

9. The element according to claim 7 wherein an end of said shaft portion opposite from said head portion is configured to allow connection of an indexing mechanism to said shaft portion whereby promoting rotating movement of said element about said elongated axis.

10. The element according to claim 7 wherein the inner generally curved surface of said head portion extends outward to the periphery of said wings and is textured to enhance frictional surface contact between said wings and the outer peripheral surface of said golf ball thereby promoting conjoint rotation of said golf ball with said element.

11. The element according to claim 10 wherein the inner generally curved surface of each wing is defined by at least two different sections whereby allowing said element to be used in combination with golf balls having different diameters.

12. The element according to claim 10 wherein a relief is defined at the center of said head portion, and wherein said inner generally curved surface extends outward from said relief.

13. In combination with a fixture adapted to accept and present a golf ball to a printing apparatus whereat one or more images are imprinted onto a spherical and dimpled outer surface of said golf ball during an ink pad printing process, and wherein said fixture includes a mechanism for indexing said ball through a predetermined range of rotation, with said fixture further including at least two axially aligned and spaced elements which accommodate a golf ball to be imprinted with said images therebetween, and wherein at least one of said elements comprises a shaft portion defining an elongated axis about which said element and the golf ball engaged thereby rotates and a head portion disposed at a first end of said shaft portion, said head portion defining a generally curved inner surface extending thereacross and generally corresponding to a segment on the outer dimpled surface of said golf ball, with said head portion defining a plurality of circumferentially spaced wings radially extending outwardly from said axis for engaging, positioning and supporting said golf ball without affecting damage to the outer dimpled surface thereof, and whereby said wings extend radially outward from said elongated axis of said shaft portion to enhance the golf ball engaging surface area and moment arm of said element while defining a spherical surface of revolution which, when said element is rotated, interferes with said predetermined area required for printing, and whereby said head portion of said element is configured between said wings to remain functionally removed from said predetermined area required for imprinting said image on the outer spherical and dimpled surface of said golf ball.

14. The fixture element according to claim 13 wherein a second end of said shaft portion is designed to be connected to said indexing mechanism such that when said ball is rotationally indexed non-matching rotation of said ball is minimized.

15. The fixture element according to claim 13 wherein the inner generally curved surface of each wing is defined by at least two different sections whereby allowing said element to be used in combination with golf balls having different diameters.

16. The fixture element according to claim 13 wherein the inner generally curved surface of said head portion extends outward to the periphery of said wings and is textured to enhance frictional surface contact between said wings and the outer spherical surface of said ball thereby promoting rotation of said ball conjointly with said element to enhance positioning of said ball during the printing process.

* * * * *